US005541358A

United States Patent [19]

Wheaton et al.

[11] Patent Number: 5,541,358

[45] Date of Patent: Jul. 30, 1996

[54] POSITION-BASED CONTROLLER FOR ELECTRONIC MUSICAL INSTRUMENT

[75] Inventors: James A. Wheaton, Fairfax; Erling Wold, El Cerrito; Andrew J. Sutter, Los Angeles, all of Calif.

[73] Assignee: Yamaha Corporation, Japan

[21] Appl. No.: 37,924

[22] Filed: Mar. 26, 1993

[51] Int. Cl.[6] ..... G10H 1/00; G10H 5/00

[52] U.S. Cl. ..... 84/645; 84/658

[58] Field of Search ..... 84/615–620, 622–633, 84/645, 653–665, 600, 678–690, 692–711

[56] References Cited

U.S. PATENT DOCUMENTS

| | | | |
|---|---|---|---|
| 4,078,476 | 3/1978 | Kawachi . | |
| 4,776,253 | 11/1988 | Downes . | |
| 4,905,560 | 5/1990 | Suzuki et al. . | |
| 4,962,688 | 10/1990 | Suzuki et al. . | |
| 4,980,519 | 12/1990 | Mathews . | |
| 5,107,746 | 4/1992 | Bauer . | |
| 5,192,826 | 3/1993 | Aoki | 84/626 X |

FOREIGN PATENT DOCUMENTS 0264782 4/1988 European Pat. Off. .

OTHER PUBLICATIONS

The New Grove Dictionary of Musical Instruments, Edited by Stanley Sadie pp. 575–576. 1984.

"The Radio Drum as a Synthesizer Controller", Bob Boie, AT&T Bell Labs, Max Mathews, Music Dept., Stanford University, Andy Schloss, Music Dept., Brown University.

"Experiments With A Gestural Controller", George W. Logermann, Ph.D., Intelligistics, Inc.

*Primary Examiner*—Stanley J. Witkowski

*Attorney, Agent, or Firm*—Graham & James

[57] ABSTRACT

A performance unit is provided that is freely movable within a three-dimensional performance region. Control circuitry is used to detect a position of the performance unit with respect to a reference point in the performance region and to generate a position signal. The position signal may be used as the basis either for generating a musical tone by an electronic musical instrument or for controlling a device that imparts an effect to, or otherwise controls a parameter of, a musical tone output from a musical instrument.

50 Claims, 9 Drawing Sheets

POSITION-BASED CONTROLLER FOR ELECTRONIC MUSICAL INSTRUMENT

BACKGROUND OF THE INVENTION

1. Field of the Invention.

The present invention relates generally to devices for controlling electronic musical instruments.

2. Description of the Prior Art and Related Information.

Electronic musical instruments have greatly broadened the range of musical parameters that may be controlled by a performer. Frequently, however, this additional control is effected by the use of devices that demand additional virtuosity of the performer. Not only basic instrument-playing skills, but the added ability to simultaneously monitor computer display screens, regulate foot switches or pedals and manipulate joysticks, sliders, wheels or other paraphernalia with hand motions unrelated to conventional playing technique may be required as a result. Moreover, such devices frequently need to be located on the floor, a keyboard, or some other object that is not easily movable, thereby requiring the performer to stay in their vicinity. Consequently, such devices expressive benefits are often counterbalanced by their awkward and unnatural performance demands.

Performers have long known that freedom of movement can benefit both the musical expressiveness and visual interest of a performance. Devices that use parameters of a performer's motions, such as acceleration or velocity, to control a musical tone signal can offer some musical and visual advantages over other types of controllers. However, because such devices typically require sustained, or even abrupt, motions in order to have an effect, they too can make a performance somewhat unnatural. For example, movements may be required that are not consonant with the mood of the music being played.

Consequently, there is a need for a system offering a performer enhanced musical expressive capabilities while permitting him or her to move freely and naturally during performance.

SUMMARY OF THE INVENTION

The present invention is directed to a system that controls musical parameters based on a performer's or instrument's position within the performance space, thereby avoiding many of the drawbacks described above. Such a system offers a more natural type of control, since many types of musical instrument can easily be played as the performer changes his or her location within the performance area. The present invention gives the performer the flexibility to make gradual changes in musical parameters, and permits effects to be held without the necessity of inappropriate or continuous motion.

More specifically, the present invention is directed to a performance unit that is freely movable within a three-dimensional performance region, such as a concert stage area, together with means for controlling a musical tone on the basis of a detected position of the performance unit. A processing unit establishes a reference point within the performance region, determines the position of the performance unit with respect to the reference point and generates a position signal. The processing unit thereby relates data representative of the position of the performance unit to the "objective" coordinate system of the performance region, unlike prior art controllers that rely on motion sensors, which relate sensor data only to a "subjective" set of coordinate axes based on the axes of the motion sensor itself.

The position signal may be used to control the pitch, volume or other attribute of a musical tone generated by an electronic musical instrument. For example, the present invention could be embodied as an "air xylophone", permitting a performer to select a pitch by moving the performance unit into a predefined three-dimensional subregion of the performance region, or an "air trombone", permitting a performer to vary pitch substantially continuously with the performance unit's position. Alternatively, the position signal may be used to control an effects unit imparting effects such as tremolo or reverberation, among others, to the output of a musical instrument.

The position signal may be used to control the kind of attribute or effect to be imparted to the musical tone, the degree to which it is imparted, or both. For example, in the "air xylophone" embodiment, the position of the performance unit within a subregion may be mapped to control the volume of the tone. Overlapping subregions of the performance region may be mapped to distinct effects, so that multiple effects are imparted to the musical tone when the performance unit is located where the subregions intersect.

The versatility of the present invention is further enhanced by the ability to use additional characteristics, such as the orientation of the performance unit with respect to an axis containing the reference point, as the basis for control signals generated by the processing unit. The performance unit may be provided with a plurality of motion sensors, such as linear accelerometers, to detect one or more characteristics of the motion of the performance unit that also may serve as the basis of such control signals. All such additional control signals may be used to effect control over additional parameters of a musical tone, to constrain the ability of the position signal to control a musical tone parameter, or both.

The present invention may also be provided with means permitting a performer to reset the reference point for position determinations during a performance, so that he or she is not constrained to return to specific parts of the performance region in order to achieve particular musical effects. Means may also be provided whereby a performer can re-map the performance effects associated with different spatial regions in order to be able to tailor such mappings to the particular physical parameters of the performance region, be it a night-club stage or a sports arena. Means such as software triggers also may be provided for changing mappings for different musical pieces, or even during a single musical piece.

The present invention greatly expands the expressive possibilities available to a performer by permitting control over musical parameters to be achieved by natural changes of position within a three-dimensional performance region. The present invention thereby avoids constraining the performer to employ particular motions in order to achieve such control, and may be adapted to both discontinuous and substantially continuous types of parameter control, unlike systems that achieve control over musical tone parameters solely on the basis of a detected degree of motion.

BRIEF DESCRIPTION OF THE DRAWINGS

The invention will be described in reference to the accompanying drawings, wherein.

FIG, 1 is a block functional diagram of the elements of a preferred embodiment of the present invention used in conjunction with an electronic musical instrument.

DESCRIPTION OF THE PREFERRED EMBODIMENT

The following description is of the best currently contemplated mode of carrying out the invention. This description is made for the purpose of illustrating general principles of the invention and is not to be taken in a limiting sense. The scope of the invention is best determined by reference to the appended claims.

Figure 1:
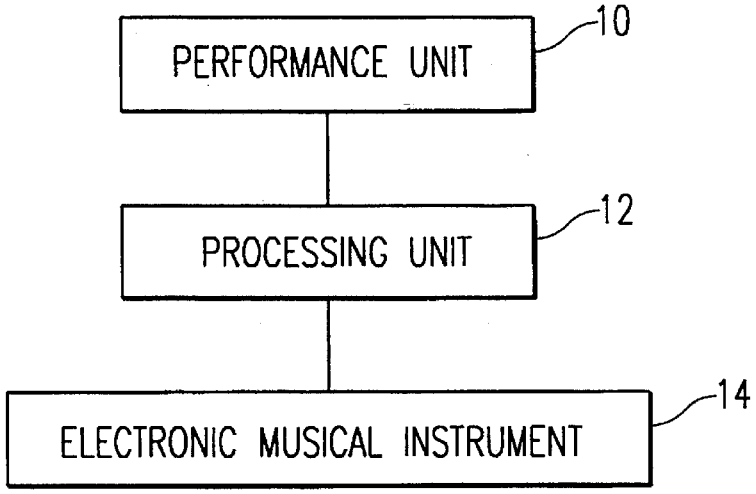

FIG. 1 is a block diagram of the functions of a preferred embodiment of the present invention. The performance unit 10 transmits analog or digital data from one or more sensors contained in such unit to processing unit 12. Processing unit 12 uses one or more microprocessors to compute the position of the performance unit from the sensor data and generate digital musical tone control signals. In this embodiment, such signals are input to an electronic musical instrument 14. Electronic musical instrument 14 may contain either or both of performance unit 10 and processing unit 12, or such units may be independent of the instrument.

Figure 2:
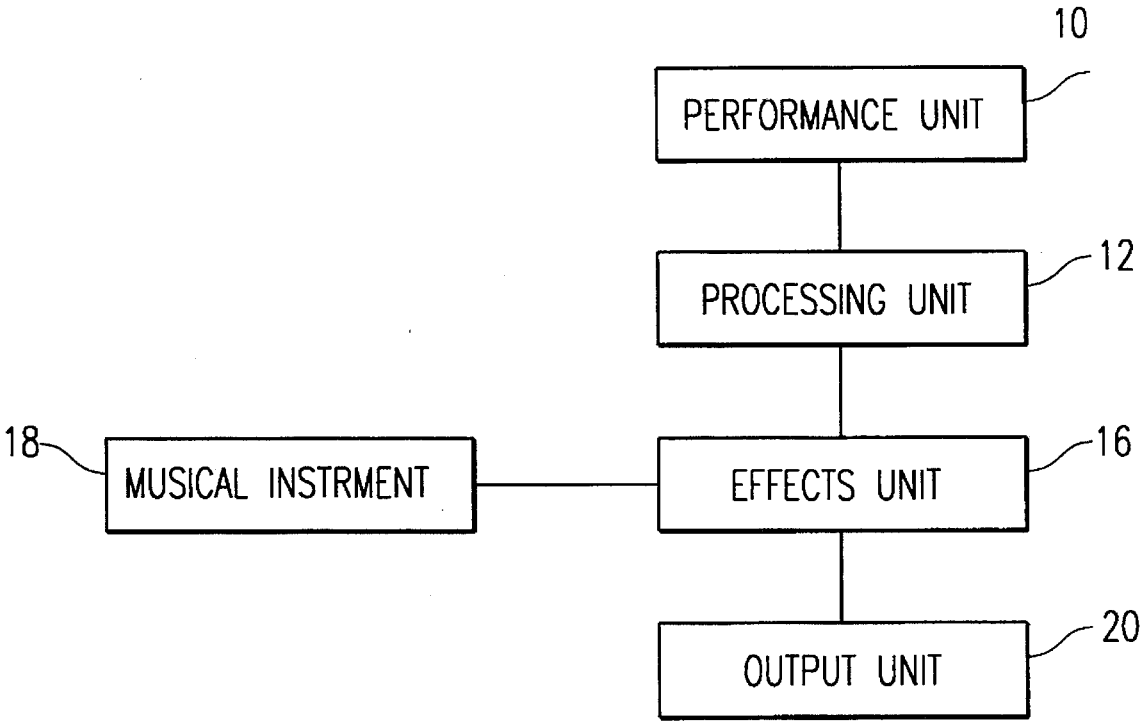
FIG. 2 is a block functional diagram of the elements of the present invention as used in another preferred embodiment.

FIG. 2 is a block diagram of a second preferred embodiment of the present invention. In this embodiment, processing unit outputs control signals to musical effects unit 16 based on the sensor data received from performance unit 10. Effects unit 16 also receives input audio signals from musical instrument 18, which may be, for example, a conventional musical instrument with electrical audio pick-up. Effects unit 16 processes the audio input and control signals to produce effected audio output, which may be further processed by amplifiers, digital/analog converters and speakers in output unit 20.

Figure 3:
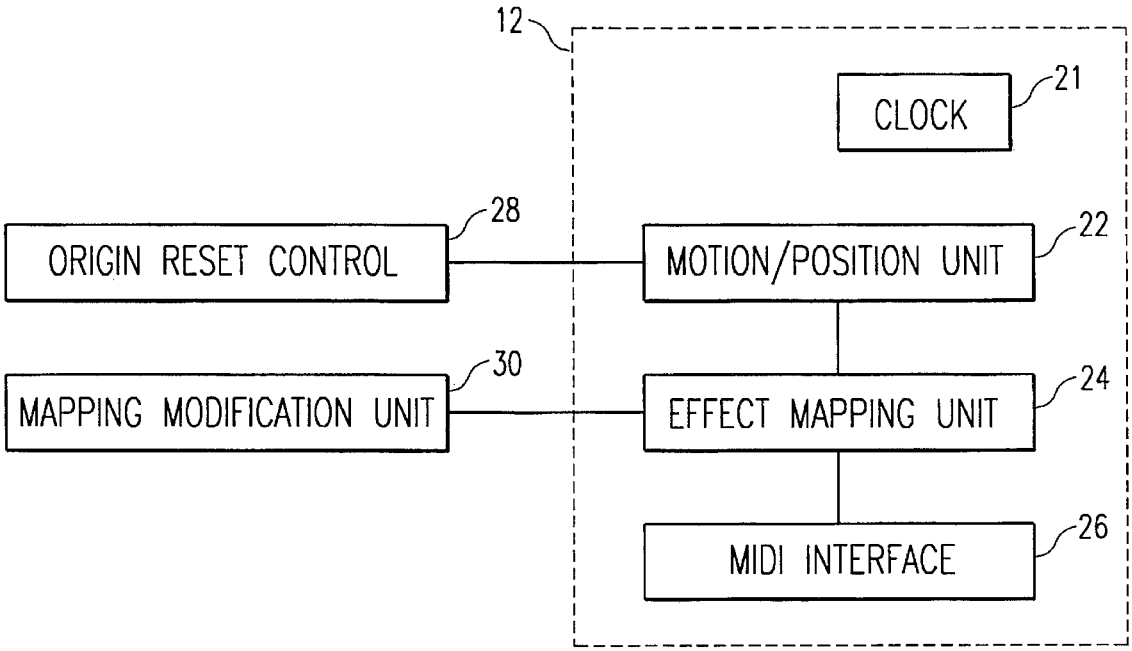
FIG. 3 is a block functional diagram of the processing unit of the present invention.

FIG. 3 is a block functional diagram of processing unit 12, which comprises clock 21, motion/position unit 22, effect mapping unit 24 and, in the preferred embodiment, an interface 26 that generates standard MIDI (Musical Instrument Digital Interface) control signals.

Motion/position unit 22 receives sensor data input from performance unit 10 at time intervals ("measurement cycles") equal to a predetermined number of cycles of clock 21; if such input is in analog form, it is next processed by analog/digital converters in motion/position unit 22. Motion/position unit 22 then computes the position of performance unit 10 within the performance region on the basis of the sensor data with reference to a Cartesian coordinate system (whose respective axes will hereinafter be referred to individually as the X, Y and Z axes, and collectively as the "space axes"). Motion/position unit 22 may also compute various additional data including, for example: translational velocities in the X, Y and Z directions; translational accelerations in the X, Y and Z directions; azimuth, elevation and roll of the performance unit 10 with respect to the X axis; angular velocity, if any, of performance unit 10 about an axis through its center; and higher-order time derivatives of any of the above quantities. All such computed data are output to effect mapping unit 24. Unit 22 is also provided with memory registers capable of storing sensor data, final computed quantities and certain intermediate results of computation from at least two immediately previous measurement cycles.

In the preferred embodiment of the present invention, performance unit 10 is provided with origin reset control 28. Activation of control 28 causes transmission of a control signal to motion/position unit 22 permitting the performer to designate the location of performance unit 10 as the origin of the performance region coordinate system and the orientation of unit 10 as being parallel with the orientation of the performance region coordinate system. Activation of control 28 also resets clock 21 to time $\tau=0$.

Effect mapping unit 24 is programmed to generate one or more musical tone control signals on the basis of the computed position data (and, if desired, on the basis of the other data output from motion/position unit 22). Such tone control signals may control such attributes of a musical tone as pitch, volume, timbre or decay envelope, among others, or such musical effects known in the art as reverberation, chorus, vibrato, and tremolo, among others. In the preferred embodiment, effect mapping unit 24 is provided with mapping modification unit 30, which permits selection of various musical effects to be produced in accordance with the detected position of performance unit 10 and modification of the parameters of the spatial regions associated with such musical effects. Mapping modification unit 30 may be integral with an electronic musical instrument, or may be provided by means of software operating in a remote computer capable of communicating with effect mapping unit In a preferred embodiment, all musical tone control signals output from unit 24 are processed by a interface 26, from which they are sent as standard MIDI control signals to electronic musical instrument 14 or effects unit 16, although nonstandardized signals could be employed.

Each of the functions of the units 22–26 may be embodied as software, hardware or a combination thereof. In addition, each of such functions may be performed by a unit physically located on the performance unit 10, by an associated remote computer or by a dedicated free-standing unit, among other alternatives.

Figure 4:
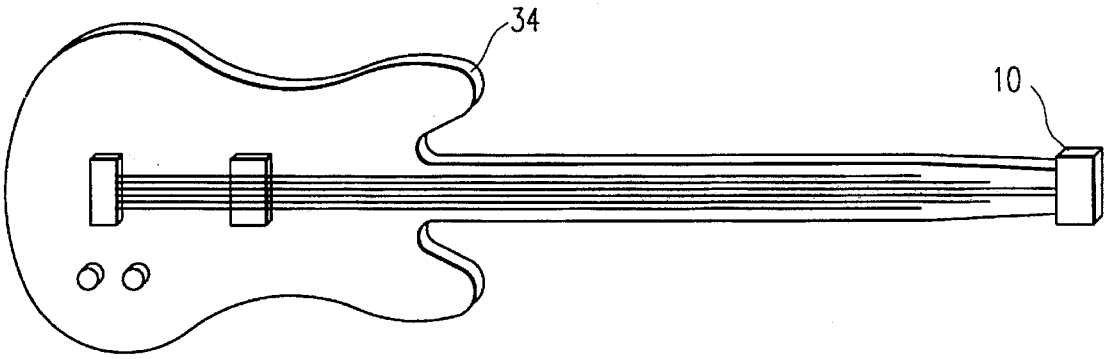
FIG. 4 is a perspective view of a musical instrument on which the present invention has been mounted.
Figure 5:
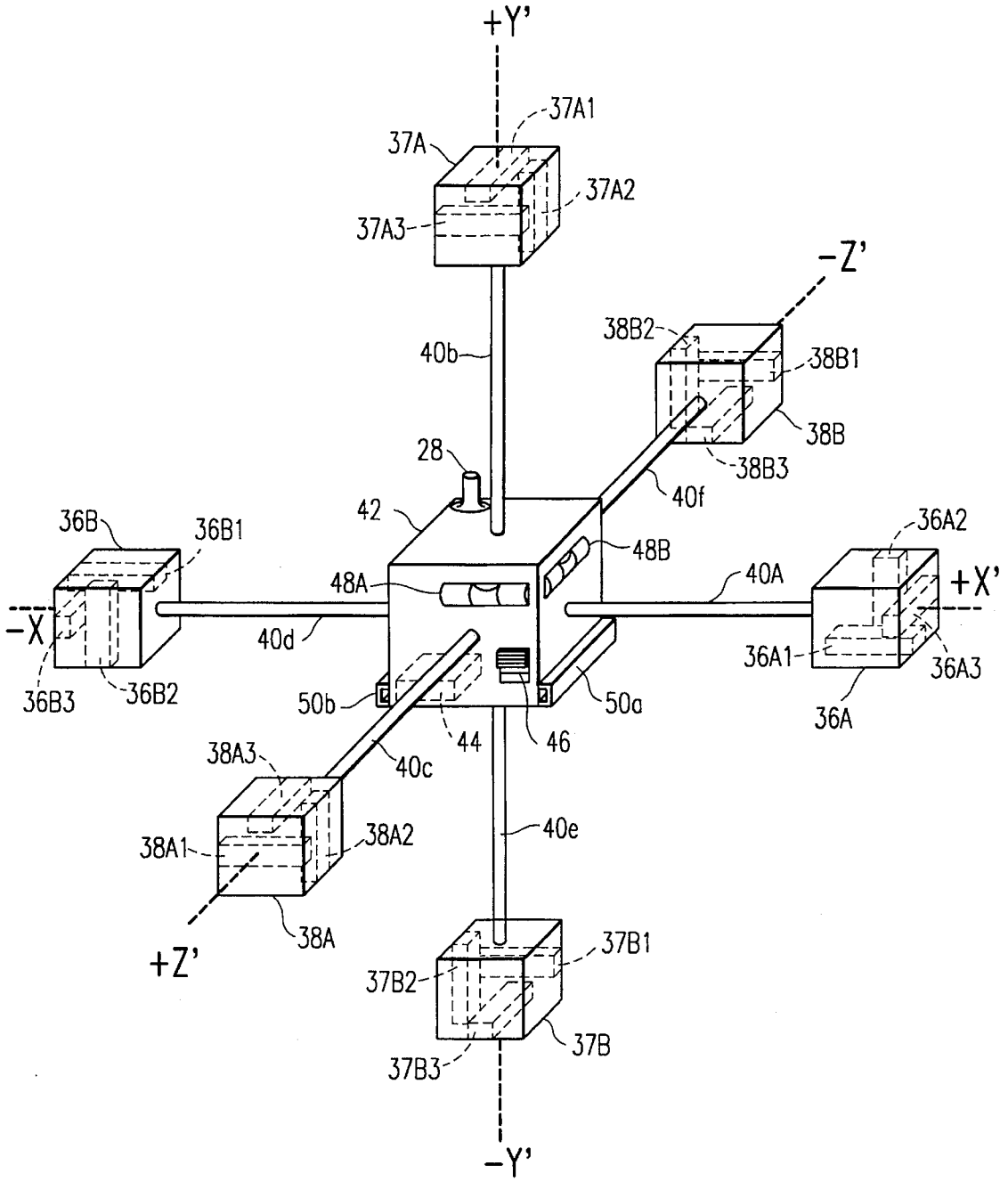
FIG. 5 is a perspective view of the performance unit in a preferred embodiment of the present invention.

FIG. 4 illustrates an embodiment of the present invention wherein performance unit 10 is mounted on movable musical instrument 34. In a preferred embodiment, the output of performance unit 10 is transmitted by an FM transmitter or other wireless means, although a coaxial cable, wires, optical fibers or other similar extended transmission media may instead be employed. Position data relating to the position of performance unit 10 may be used to control the output of musical instrument 34 on which such performance unit 10 is mounted, or may instead be used to control the output of a different instrument remote from unit FIG. 5 illustrates a preferred embodiment of performance unit 10, which may be used in either of the embodiments of the present invention illustrated in FIGS. 1 and 2. Three pairs of sensor array subunits 36–38 are disposed at the ends of six connector arms 40 of equal length, the other ends of which are connected to sensor coordination subunit 42. The arms 40 lie along three orthogonal Cartesian axes ±X', ±Y' and ±Z' (hereinafter referred to as the "body axes") whose origin coincides with the center of sensor coordination subunit 42. Each of the sensor array subunits 36A, 36B, 37A, 37B, 38A and 38B contains three linear accelerometers 36A1-3, 36B1-3, 37A1-3, 37B1-3, 38A1-3 and 38B1-3 so aligned with the respective body axes as to indicate a positive acceleration when moved in the positive direction along such body axis and a negative acceleration when moved in the negative direction along such axis. (From time to time hereinafter, accelerometers 36A1, 36B1, 37A2, 37B2, 38A3 and 38B3 will be referred to as "radial accelerometers", and the other accelerometers as "off-radial accelerometers".) Accelerometers 36A1-38B3 are miniaturized silicon-based accelerometers whose linear dimensions are small compared to the length of the arms 40.

In the preferred embodiment, sensor coordination subunit 42 is provided with origin reset control 28, power supply 44, power switch 46, a pair of levelling gauges 48, and mounting fixtures 50. Preferably, setting switch 46 to the "off" position will not erase or reset memory registers in motion/position unit 22 or effect mapping unit 24, but will prevent the transmission of sensor data to processing unit 12 and of MIDI instructions to electronic musical instrument 14 or effects unit 16. Such use of switch 46 during a performance thereby permits performance unit 10 to be moved (e.g., to a position desired as the new origin of the space axes) without such motion occasioning undesired musical effects.

Levelling gauges 48 permit the performer to ascertain whether the position unit 32 is vertically aligned with the space axes (specifically, whether the Y' axis is aligned with the Y axis) by indicating tilting in the Z and X directions. Alignment of the X' and Z' axes with the X and Z axes, respectively, is achieved ocularly.

Mounting fixtures 50 permit wires, thongs or other fasteners to be attached to performance unit 10 for those applications in which unit 10 will be affixed to a musical instrument or other member. Alternatively, performance unit 10 may be held in a performer's hand or contained in an enclosure that itself may be held or fixed to an instrument or other member.

Examples of procedures for deriving position data from sensor data when performance unit 10 is configured as illustrated in FIG. 5 will now be described, with reference to FIGS. 6–10.

Figure 6:
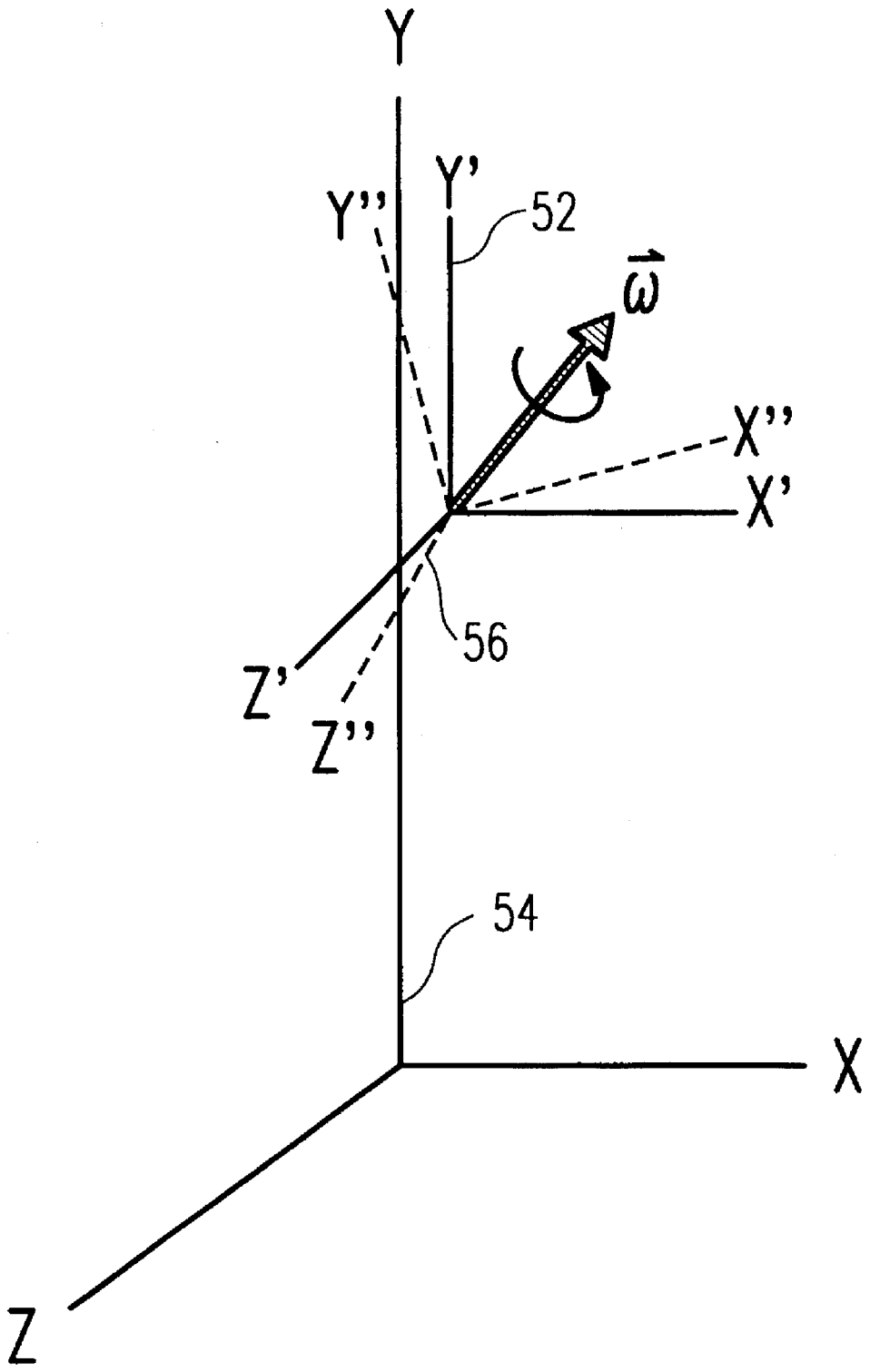
FIG. 6 is a diagram showing the orientations of the respective coordinate systems of the performance region, the performance unit of the present invention as initially oriented and such performance unit as rotated.
Figure 7:
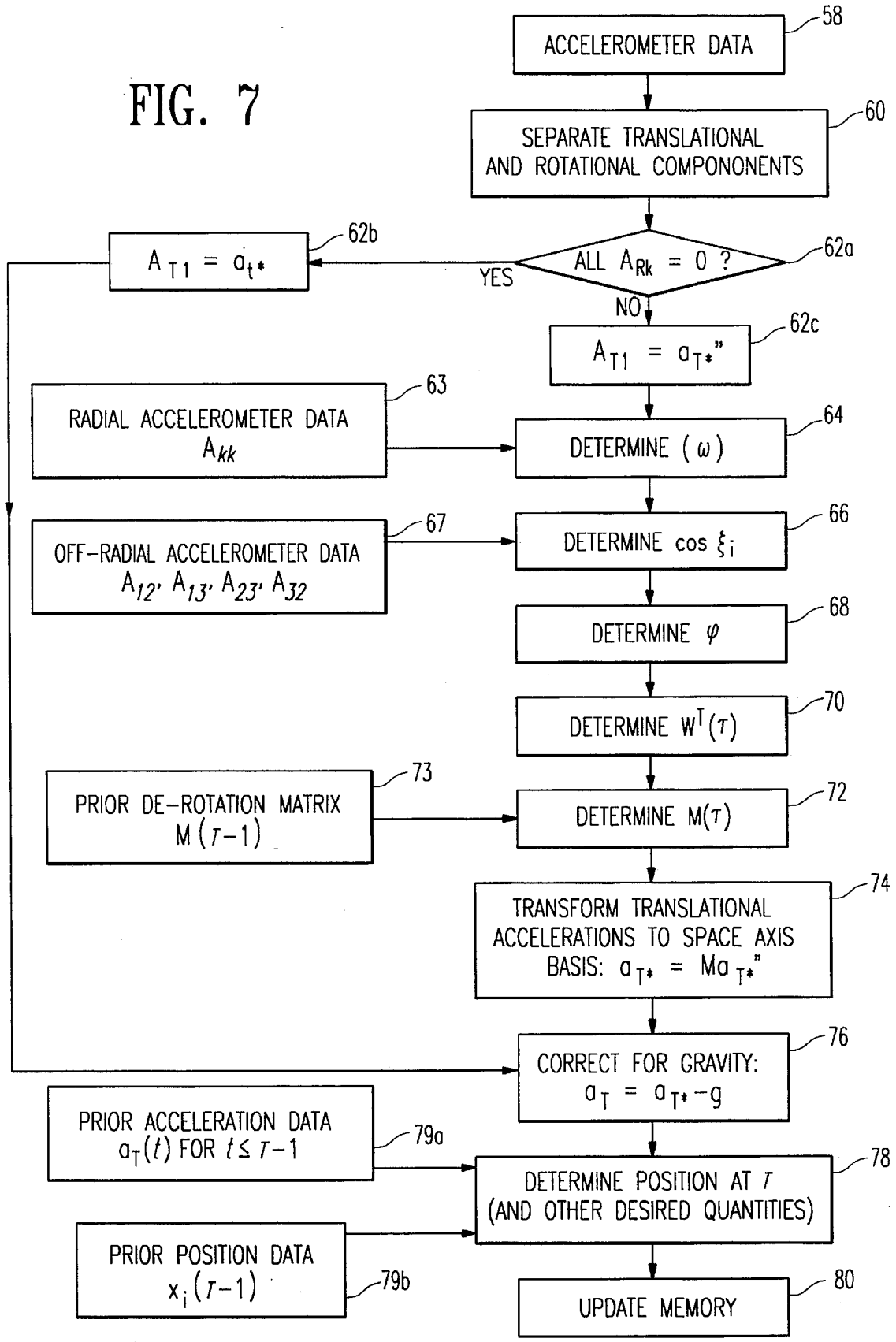
FIG. 7 is a block diagram illustrating the steps in computing the position of the performance unit from performance unit acceleration data in a preferred embodiment of the present invention.

FIG. 6 illustrates the body axis system 52 of performance unit 10 located within the space axis system 54. Motion/position unit 22 is programmed to deem each of the X, Y and Z axes to be initially parallel with the X', Y' and Z' axes, respectively, and the origin of system 54 to be initially coincident with the origin of system 52.

So long as performance unit 10 is not rotated, a translation of unit 10 parallel to the X space axis, for example, will be detected by accelerometers 36A1, 36B1, . . . 38B1, which detect motions parallel to the X' body axis, but not by accelerometers that are parallel to the Y' or Z' body axes. Conversely, a motion that "appears" to performance unit 10 as a motion in the X' direction can be interpreted as a motion in the X direction.

Since each sensor array subunit contains three orthogonally-oriented accelerometers, we may associate with each subunit an acceleration vector $A_k$ (where k=1,2, . . . 6 denotes subunits 36A, 37A, 38A, 37A, 37B, and 38B, respectively) with components $A_{ki}$ (where i=1, 2, 3 denotes the X', Y' and Z' directions, respectively). Because each sensor array subunit's set of orthogonal accelerometers has the same orientation as the body axis system, a translational acceleration of performance unit 10 will make identical contributions to each of the $A_k$. Consequently, sensor data from any one subunit, e.g. subunit 36A, will completely describe translational accelerations acting on performance unit in the non-rotational case. Since these accelerations will include acceleration due to gravity, an acceleration of g=9.8 meters/sec$^2$ in the -Y direction should be subtracted from such data.

In the following discussion, the following terminology will be used:

$X_i$ X, Y and Z directions, respectively, for i=1,2,3

$\Delta\tau$ duration of one measurement cycle, e.g. interval from time $\tau-1$ to time $\tau$ $a_{Ti}(\tau)$ translational acceleration in $X_i$ direction at $\tau$ $\bar{a}_{Ti}(\tau)$ average translational acceleration in $X_i$ direction during interval from $\tau-1$ to $\tau$ $U_{Ti}(\tau)$ translational velocity in $X_i$ direction at time $\tau$ $\bar{a}_{Ti}(\tau)$ average translational velocity in $X_i$ direction during interval from $\tau-1$ to $\tau$ $\Delta X_i(\tau)$ change in position in $X_i$ direction during interval from $\tau-1$ to $\tau$ $X_i(\tau)$ position in $X_i$ direction at $\tau$.

At time $\tau=0$, each of such acceleration, velocity and position quantities has value zero ($a_2$ being assumed at all times to have been corrected for the effect of gravity). Quantity averages are deemed equal to one-half of the sum of the respective values of such quantity at $\tau$ and $\tau-1$.

Such acceleration, velocity and position quantities may then be computed according to the following formulae:

$$a_{Ti}(\tau)=A_{ti}(\tau)-g\cdot A_1(\tau)$$

$$\bar{a}_{Ti}(\tau)=\tfrac{1}{2}[a_{Ti}(\tau)-a_{Ti}(\tau-1)]$$

$$u_{Ti}(\tau)=u_{ti}(\tau-1)+\bar{a}_{Ti}(\tau)\Delta\tau$$

$$= \Delta\tau\left[\sum_{t=0}^{\tau-1} a_{Ti}(t) + 1/2a_{Ti}(\tau)\right]$$

$$\bar{u}_{Ti}(\tau) = 1/2[u_{Ti}(\tau)+u_{Ti}(\tau-1)]$$

$$= \Delta\tau\left[\sum_{t=0}^{\tau-2} a_{Ti}(t) + 3/4a_{Ti}(\tau-1) + 1/2a_{Ti}(\tau)\right]$$

$$\Delta x_i(\tau) = \bar{u}_{Ti}(\tau)\Delta\tau$$

$$x_i = \sum_{t=0}^{\tau}\Delta x_i(t)$$

This last equation gives the components of performance unit 10's position in each of the X, Y and Z directions. Rather than storing all values of $a_{Ti}$ for $t\leqq\tau$ in order to perform the foregoing calculations, it is sufficient to store such values for $\tau$ and $\tau-1$, together with the value of the sum of the $a_{Ti}(t)$ for $t\leqq\tau-2$.

The foregoing procedure will not be sufficient to determine the position of performance unit 10 if the performance unit is permitted to undergo rotations, for the following reason: When body axis system 52 is rotated relative to the space axes, an observer in space axis system 54 will see rotated body axis system 56 as the result. However, accelerometers 36A1, 36B1, . . . 38B1 will rotate along with performance unit 10, so that now an acceleration in the X" direction (as observed in the performance region), rather than in the X direction, will "appear" to performance unit 10 as an acceleration in the X' direction without Y' or Z' components. Subsequent rotations may again redirect the X'-aligned accelerometers along 8 arbitrary directions in space axis system 54, so that many different directions as seen from the performance region all will look the same when seen from the body axis perspective.

It is desirable to permit rotations of performance unit 10, both because greater expressive freedom may thereby be given to the performer, and because it is difficult for performers entirely to avoid such rotations even when an attempt is made to do so. Since the sensor data are all from the body axis point of view, permitting rotations of unit 10 means that the orientation of the body axis system with respect to the space axis system must be determined during each measurement cycle before the change of position in the performance region may be computed.

Such orientation is determinable if performance unit 10 is configured as illustrated in FIG. 5, because accelerometers 36A1–38B3 are disposed so as to be able to detect the centripetal and other accelerations undergone by sensor array subunits 36–38 during a rotation of performance unit 10 around an arbitrary axis. Motion/position unit 22 may be programmed to (i) discriminate between translational and rotational acceleration components on the basis of accelerometer data, (ii) determine a mathematical transformation that transforms the basis of rotated body axis system 56 into the basis of space axis system 54, and (iii) transform the translational components of the accelerometer data into the space axis system. The computational steps performed by motion/position unit 22 are illustrated schematically in FIG. 7, and described in more detail below.

Figure 8:
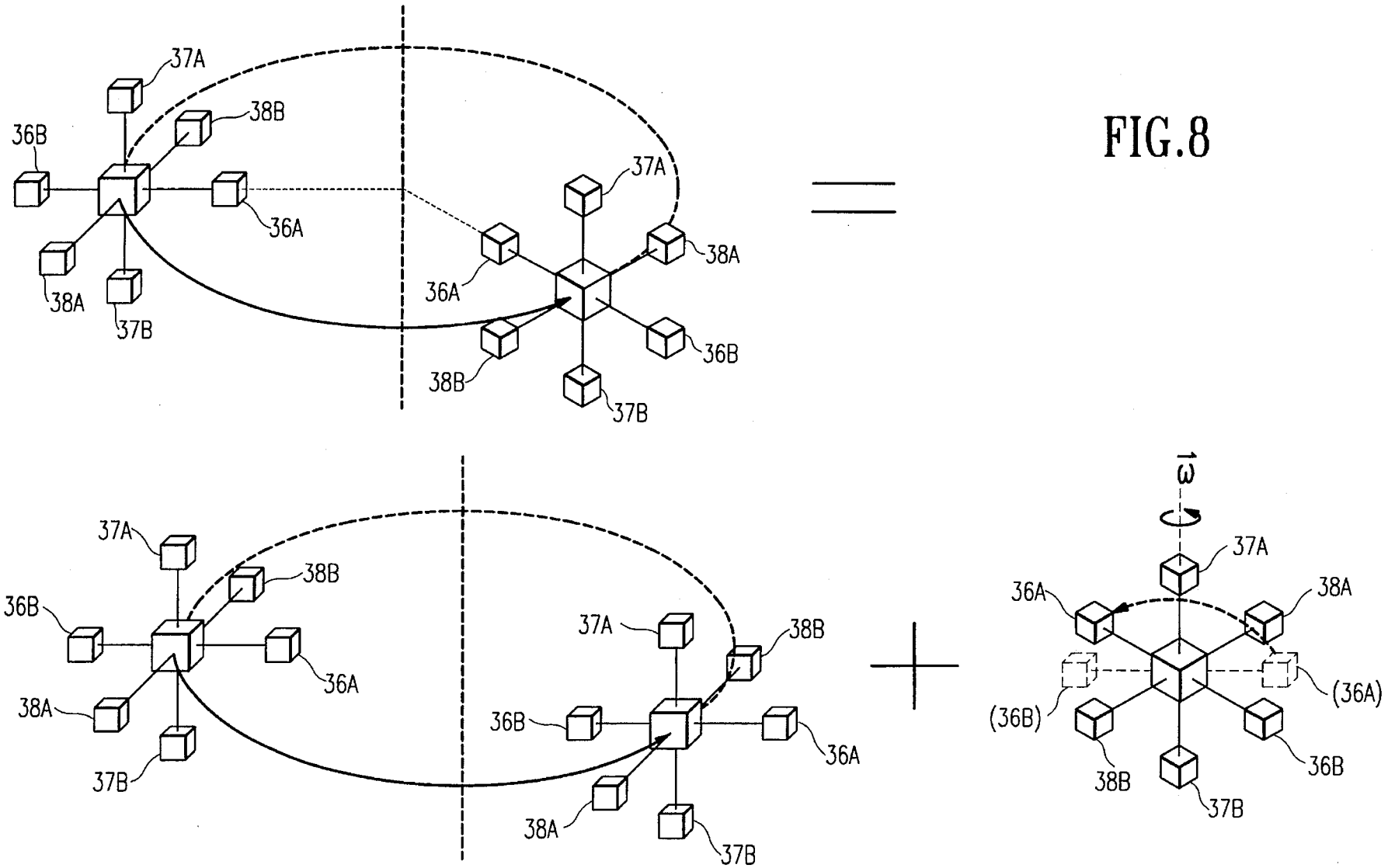
FIG. 8 is a diagram illustrating certain possible motions of the performance unit.

The computation begins at step 60, in which the translational and rotational components of accelerometer data 58 output by each accelerometer at time $\tau$ are distinguished. The acceleration vector associated with each sensor array subunit may be expressed by the sum $A_k=A_{Rk}+A_{Tk}$, where the subscripts "R" and "T" denote the rotational and translational accelerations experienced by the subunit. As noted above, each sensor array subunit experiences the same translational acceleration. On the other hand, a rotation about an axis through the origin of body axis system 52 will cause each subunit pair (36A, 36B), (37A, 37B) and (38A, 38B) to experience equal and opposite motions. A rotation of performance unit 10 may always be deemed to be about an axis passing through the origin of body axis system 52, because all motions of the performance unit in three-dimensional space may be expressed as a translation, a rotation about an axis through the origin of the body axis system, or a sum of a translation and such a rotation. For example, FIG. 8 illustrates this principle when the motion may also be described as a rotation wherein sensor array subunit 36A always points toward a rotational axis parallel with the Y' axis but not passing through such origin. By configuring each of the sets of orthogonal accelerometers in the respective sensor array subunits to have the same orientation as body axis system and $A_{Tk}$ may be determined from the following:

$$A_{Tk}=\tfrac{1}{2}(A_k+A_{k+3});$$

$$A_{Rk}=A_k-\tfrac{1}{2}(A_k+A_{k+3}).$$

If it is determined in step 62 that all $A_{Rk}$ are zero, $A_{T1}$ is set equal to the vector $A_{T*}$", the translational acceleration experienced by performance unit 10 before correcting for gravity, as expressed in the basis of space axis system 54; the process then continues with step 76. If any $A_{RK}$ are found to be non-zero, $A_{T1}$ is set equal to the vector $a_{T*}$", the translational acceleration before correcting for gravity, as expressed in the basis of rotated body axis system 56, and the computation continues with step 64.

Figure 9:
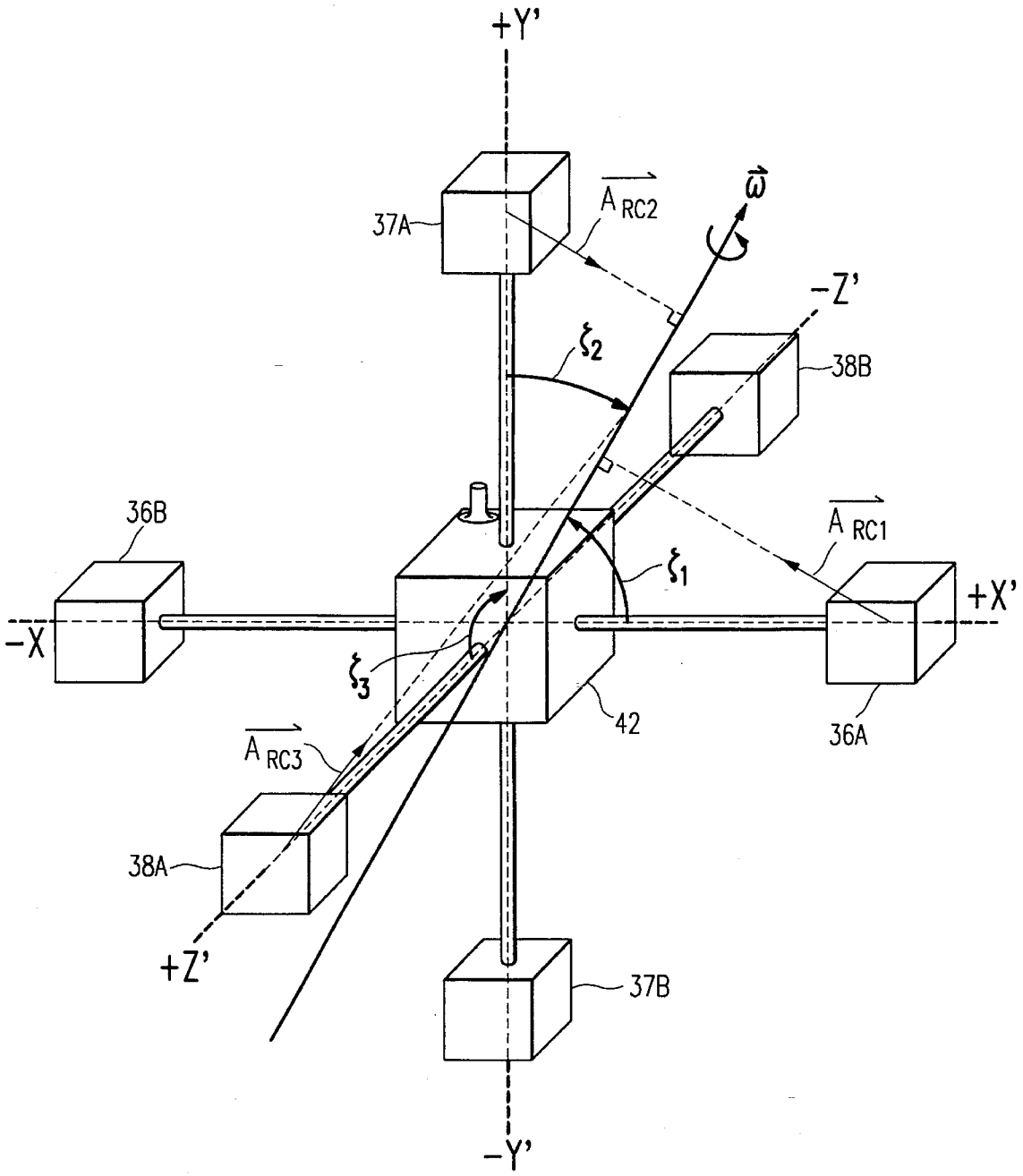
FIG. 9 is a diagram illustrating the orientation of an axis of rotation with respect to the embodiment of the performance unit shown if FIG. 5.

Step 64 is the determination of the magnitude of the angular velocity vector $\omega$ associated with the rotation of the body axis system 52. Each of the $A_{Rk}$ is a sum of a tangential acceleration, $d\omega/dt$, which starts, speeds up, slows down or stops a rotation, and a centripetal acceleration, $A_{RCk}$, which will have magnitude $\omega^2 r$ (where r is a radius to be determined) even when there is no tangential acceleration. As shown in FIG. 9, $\omega$ makes angles $\xi_1, \xi_2$ and $\xi_3$ with the X', Y' and Z' axes, respectively. Each sensor array subunit will describe a circle (or arc thereof) as it rotates around $\omega$. The plane of such circle will be perpendicular to $\omega$, and will contain the centripetal acceleration vector $A_{RCk}$ pertaining to such subunit. Each of the radial accelerometers 36A1, 36B1, 37A2, 37B2, 38A3 and 38B3 will be orthogonal to any tangential accelerations experienced by performance unit 10, but will measure a component of the centripetal acceleration given by $$A_{ii}=|A_{RCi}|\sin\xi_i=\omega^2 d\,\sin^2\xi_i=\omega^2 d(1-\cos^2\xi_i),$$

where d is the distance between the origin of the body axis system 52 and the center of mass of the accelerometer. Radial sensor data 63, comprised of the $A_{kk}$ where k is allowed to vary only over {1, 2, 3}, then gives the magnitude of the angular velocity by $$\omega=[-(\Sigma A_{kk})/2d]^{1/2},$$

where the positive root is taken when evaluating the square root.

The orientation of $\omega$ with respect to the body axis system 52 (which is identical to its orientation with respect to rotated body axis system 56) is computed in step 66. The orientation may be expressed in terms of the direction cosines cos $\xi_i$ of $\omega$ with respect to the body axes, the magnitudes of which are given by $$|\cos\xi_i|=[1-(2A_{ii}/\Sigma A_{kk})]^{1/2}.$$

The signs of the direction cosines are determined on the basis of off-radial accelerometer data 67, comprised of $A_{13}$, $A_{23}$, $A_{12}$ and $A_{32}$, and a look-up table stored in the memory of motion/position unit 22 that is derived in the following manner: If $\omega$ does not lie along one of the body axes, sensor array subunits 36A and 37A will lie either on the same side of $\omega$ or on opposite sides of it. If on the same side, $A_{13}$ and $A_{23}$ will both have the same sign, and $\omega$ will lie in the ¼-space defined by quadrants II or IV of the X' -Y' plane (with Z' taking any value), according to whether the sign of $A_{13}$ is negative or positive, respectively. If $A_{13}$ and $A_{23}$ have different signs, $\omega$ lies in the ¼-space defined by quadrants I or III, according to whether $A_{13}$ is negative or positive. A similar analysis may be applied to the X' -Z' plane, using outputs $A_{12}$ and $A_{32}$. If $\omega$ lies along a body axis or in a plane formed by two body axes, one or more of such off-radial accelerometer data will be zero. A unique pattern of signs and zeroes of such off-radial accelerometer data exists for each of the eight spatial octants, twelve planar quadrants and six half-axes in or along which $\omega$ might lie. Other sets of off-radial accelerometer data may be used for determining the signs of the direction cosines in lieu of those described above, provided that a look-up table pertinent to such other data has been prepared.

Step 68 computes the angle $\phi$ through which body axis system rotated during the measurement cycle ending at time $\tau$. At the beginning of such cycle, body axis system 52 had angular velocity $\omega(\tau-1)$, and had at the end of such cycle angular velocity $\omega(\tau)$. The average angular velocity during the measurement cycle may be approximated by $$\omega=\tfrac{1}{2}[\omega(\tau)-\omega(\tau-1)],$$

in which case $\phi$ is given by $\omega\Delta\tau$.

Step 70 derives matrix expressions for the transformation W that takes body axis system 52 into rotated body axis system 56 and for the inverse of such transformation, $W^T$. Determination of W is equivalent to determining the coordinates of the unit vectors $e_i''$ of rotated body axis system 56 expressed in terms of body axis system 52. By inverting the transformation, system 56 is effectively "de-rotated" back to the orientation of system 52 as such existed at time $\tau-1$.

Figure 10:
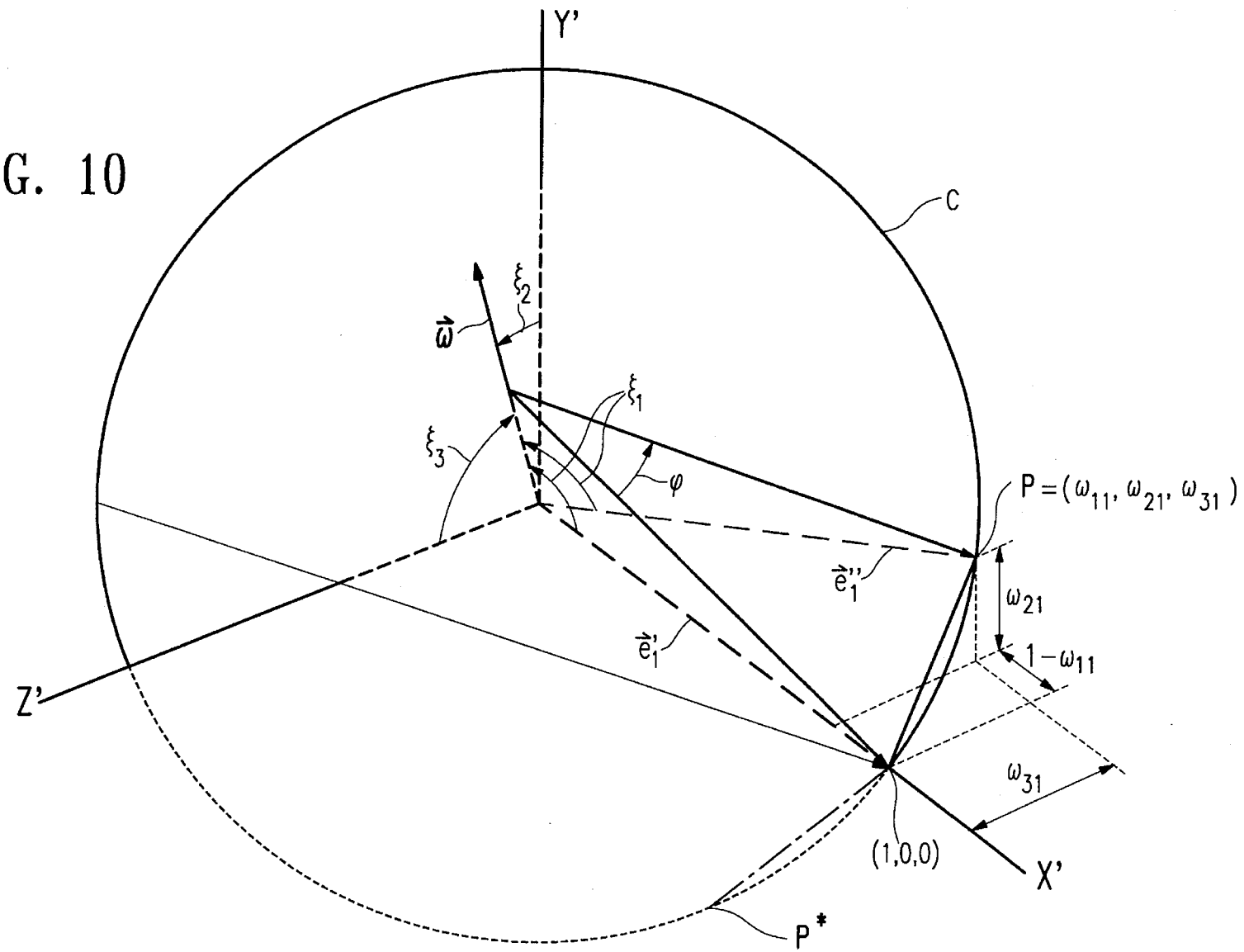
FIG. 10 is a diagram illustrating the transformation of certain vectors in connection with a rotation of coordinate systems as shown in FIG. 6.

The transformation of the $e_i'$ (the unit vectors of body axis system 52) into the $e_i''$ satisfies the following three conditions: (i) since each $e_i''$ is a unit vector its tip will lie on the sphere, of radius 1 about the origin of system 52; (ii) the tip of each $e_i''$ lies in a plane containing the circle C traced out by the tip of $e_i'$, which plane is perpendicular to $\omega$ and intersects the $X_i$axis at the tip of $e_i'$; and (iii) the tips of $e_i'$ and $e_i''$ mark the ends of a chord of an arc of C having central angle $\phi$ and radius $\sin \xi_i$, so that the length of the chord is $2\cdot\sin \xi_i\cdot\sin(\phi/2)$. FIG. 10 illustrates the example of the unit vector $e_1'$ along the X' axis, which is transformed into $e_1''$ by the rotation. Using $\{w_{j1}\}$ to denote the components of $e_1''$ in the $X_i'$ basis, the above conditions may be expressed algebraically as:

$$w_{11}2+w_{21}^2+w_{31}\,2=1; \tag{I}$$

$$w_{11}\cdot\cos\xi_1+w_{21}\cdot\cos\xi_2+w_{31}\cdot\cos\xi_3=\cos\xi_1; \tag{II}$$

$$\begin{aligned}(w_{11}-1)^2+w_{21}^2+w_{31}^2 &= 4\cdot\sin^2\xi_1\cdot\sin^2(\phi/2) \\ &= 4\cdot(1-\cos\phi)\cdot A_{11}/\Sigma A_{kk},\end{aligned} \tag{III}$$

where k varies over {1, 2, 3 }. As FIG. 10 suggests, these conditions are satisfied by two points P and P* on C, so motion/position unit 22 is programmed to add the additional condition that $\phi$ always is to be taken in the counterclockwise sense. Such condition may be expressed vectorially by the inequality $$\omega\cdot[-A_{RCk}\times(e_1''-e_1')]>0,$$

using the vector dot and cross products, or algebraically by the inequality $$\det V>0, \tag{IV}$$

where det V is the determinant:

$$\begin{vmatrix} \cos\xi_1 & \cos\xi_2 & \cos\xi_3 \\ 1-\cos^2\xi_1 & -\cos\xi_1\cos\xi_2 & -\cos\xi_1\cos\xi_3 \\ w_{11}-1 & w_{21} & w_{31} \end{vmatrix}$$

Equations (I)–(IV) may be further simplified and explicit formulae for the solutions $\{w_{j1}\}$ in terms of quantities computed in previous steps may be provided in motion/position unit 22's software, or such unit may be provided with software (for example, commercially-available software such as MATHEMATICA®)for the solution of the implicit system (I)–(IV). Repetition of this process for all three of the $e_i''$ leads to a 3×3 matrix expression of $W(\tau)=(W_{ji})$.

Rotations are orthogonal transformations, which means, among other things, that the matrix expression of the inverse of a rotation is the transpose of the rotation matrix itself. Consequently, the matrix $W^T(\tau)=(w_{ij})$ describes the transformation that "de-rotates" rotated body axis system 56 back to the same orientation that body axis system 52 had at $\tau-1$.

Step 72 computes the de-rotation matrix $M(\tau)$, which transforms rotated body axis system 56 into space axis system 54. As described above, body axis system 52 initially is deemed to be aligned with space axis system 54. Motion/position unit 22 is programmed to set $M(0)=1$, the 3×3 diagonal identity matrix, which value will be retained so long as no rotations occur. If the first rotation occurs at time $\tau=n$, the orientation of body axis system 52 at n–1 will have been parallel with space axis system 54, so $M(n)=W^T(n)$. The absence of a rotation in any subsequent measurement cycle ending at $\tau=p$ will leave the orientation of system 52 unchanged, so that W(p) and $W^T(p)$ may be deemed to equal 1. Consequently, $$M(\tau)=\Pi\, W^T(t)=W^T(\tau)\circ M(\tau-1),$$

where in the cumulative product t ranges from 0 to $\tau$, and $M(\tau-1)$ is the prior de-rotation matrix 73.

Step 74 next transforms the translational acceleration vector from its rotated body axis expression $a_{t*}''$ into its space axis expression $a_{T*}$, as follows:

$$a_{T*}(\tau)=W^T(\tau)\circ M(\tau-1)a_{T*}''(\tau)=M(\tau)a_{T*}''(\tau),$$

where the $a_{T*}$and $a_{T*}''$ are taken as column vectors.

In step 76, g is subtracted from $a_{T*}(\tau)$, yielding the corrected translation vector $a_i(\tau)$, with components $a_i(\tau)$. In step 78 the position of performance unit 10 is determined, on the basis of prior acceleration data 79*a* and prior position data 79*b*, according to the formulae discussed above with respect to an embodiment of the present invention wherein rotations are not permitted. In step 80, memory registers in motion/position unit 22 storing values of $M(\tau-1)$, the $a_i(\tau-1)$, and other variables of interest evaluated at $\tau-1$ are assigned the values of such variables at $\tau$, in preparation for the next measurement cycle.

Motion/position unit 22 may use accelerometer data 58 to compute quantities other than the positions, linear velocities, linear accelerations, and rotational velocities discussed above. For example, for any quantity $f(\tau)$ computed or detected as discussed above, a time derivative of such quantity may be approximated by $[f(\tau)-f(\tau-1)]/\Delta\tau$. Certain angular quantities may also be computed, such as azimuth (rotation of body axis system 52 about the Y space axis), altitude (rotation of body axis system about the Z space axis) and roll (rotation, as viewed in space axis system 54, of body axis system about the X' body axis) of performance unit 10 with respect to the space axes. For example, $$\sin\alpha=m_{13},$$

and $$\sin\beta=m_{12},$$

where $\alpha$ and $\beta$ denote the azimuth and altitude angles, respectively, and $m_{ij}$ are elements of the matrix M. This permits computation of matrices Y and Z, representing rotations about the Y and Z axes, and of matrix $R=M^T-Z\circ Y$. Roll angle $\gamma$ may then be computed from $$\cos \gamma = Re_2 \cdot e_2,$$

where $e_2$ is the column vector (0,1,0).

Various modifications could be made to the configuration of performance unit 10 illustrated in FIG. 5 that would still permit detection of the performance unit's position notwithstanding rotations of the unit. For example, if $\omega$ is constrained to lie in certain planes formed by the body axes or to be parallel to certain of such axes, fewer linear accelerometers could be used for such performance unit.

Various types of motion-detecting sensor other than miniaturized silicon-based linear accelerometers may be used in performance unit 10. Other types of linear accelerometer may be used, as may inclinometers, rotational accelerometers, linear velocity meters, rotational velocity meters, or combinations of the foregoing, in addition to or in lieu of linear accelerometers. In an alternative embodiment that does not rely on motion-detecting sensors, performance unit 10 and motion/position unit 22 may be comprised of Polhemus 3SPACE® TRACKER or ISOTRAK® tracking systems, which use low-frequency magnetic fields to yield X, Y and Z position data and azimuth, elevation and roll orientation data.

The function of effect mapping unit 24 will now be described in more detail. The primary function of effect mapping unit 28 is to receive the position signals and any other signals relating to velocity, acceleration, azimuth, elevation, roll, or other detected quantities from motion/position unit 24, map them to desired degrees of desired musical tone attributes or effects and provide appropriate control signals to, in the preferred embodiment, MIDI interface 26, or otherwise to electronic musical instrument 14 or effects unit 16.

Figure 11:
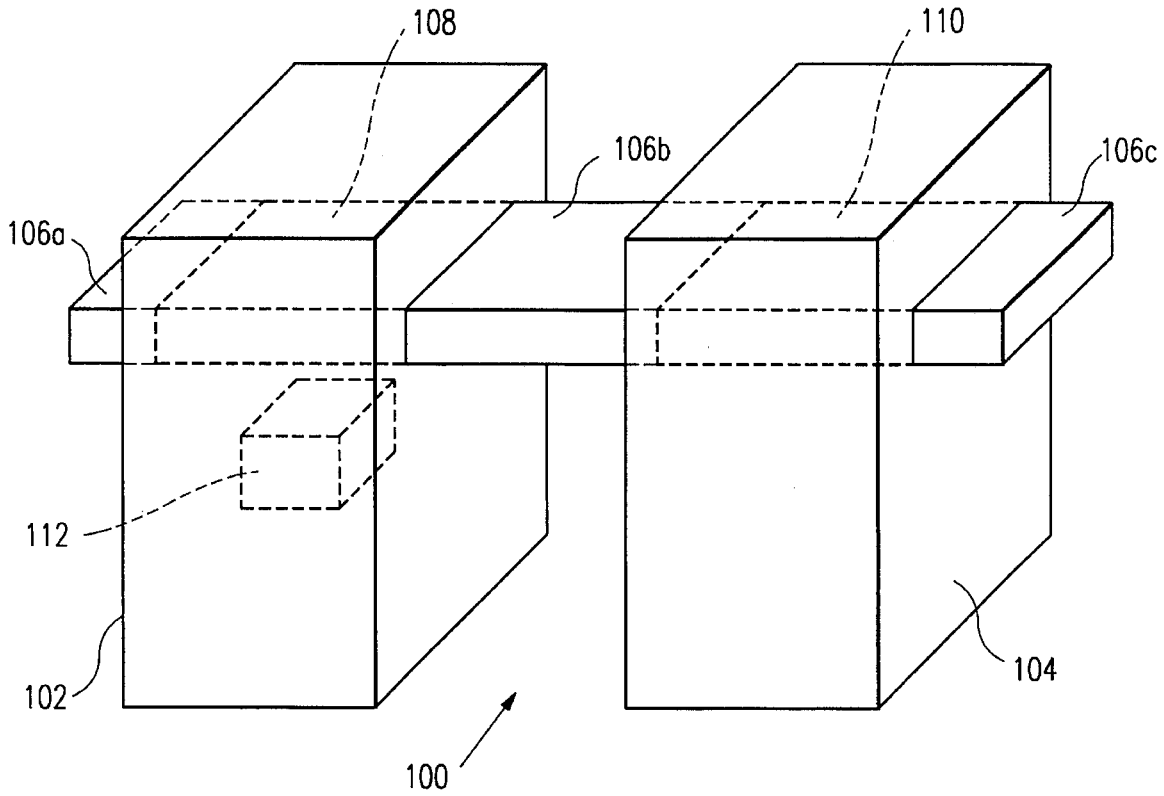
FIG. 11 is a perspective diagram illustrating an example of a partition of the performance region achievable by means of the present invention.

The user may select a "working" range for each type of input data. When a working range has been set, effect mapping unit will produce output only if the input data are within their respective working ranges. For example, FIG. 11 illustrates a possible partition of a three-dimensional performance region achievable by the present invention, such that when the position signal indicates a position in region 100 or otherwise outside regions 102–110, no musical effect will be imparted by unit The positions within regions 102–110 may be characterized by working ranges of each of the X, Y and Z coordinates. Such ranges may be set explicitly or implicitly, as by requiring that the coordinates of a position satisfy an equation for a specified sphere or other region of space. By this control, the user can effectively set "holes" in space or "slack ranges" for velocity or other quantities in which effects will not be imparted, thereby avoiding inadvertent addition of effects.

As discussed above, the range of musical attributes or effects that may be controlled by the motion/position outputs is quite varied. Both the type and the degree of such attributes or effects may be so controlled. In the preferred embodiment, the user selects what types of musical attributes or effects are to be imparted by means of mapping modification unit 30, although such attributes and effects may instead be left to the sole discretion of the manufacturer. For each musical attribute or effect that the user wishes to control, a mapping of data working range to the effect range must be made, including a minimum and maximum range to the output. For example, the present invention could be embodied as an "air xylophone" in which parallel strips of space could be mapped to particular musical pitches, or as an "air trombone" in which pitch varies substantially continuously with position. Working ranges could be set for the X, Y and Z inputs to determine the extent of the "xylophone" or "trombone" spatially; the effect range would be a single pitch within each strip for the xylophone case, and a range from the lowest to the highest desired pitch for the trombone case. Alternatively, such output range may simply be "on-off"; for example, one might activate a chorus effect or switch on a sequencer by holding the performance unit in a desired region.

A simple example to explain the mapping algorithm that converts an input value from motion/position unit 22 into an output value representative of control of a particular attribute or effect will now be described. The description is given in pseudocode. Pseudocode is a way to represent computer implementations of algorithms without having to follow the normally stringent syntactic requirements of computer language compilers. In this example it is assumed that MIDI is being used to control the desired effect. Suppose the Z coordinate is to be mapped onto MIDI controller #7, which controls the volume of a MIDI-controlled electronic musical instrument. In this simple mapping the following data are needed:

ZMIN, ZMAX working range of input to mapping function

Z current Z value

CMIN, CMAX controller range or output of mapping function

C current controller value

The function C=f(Z, ZMIN, ZMAX, CMIN, CMAX) is defined as follows:

```
if (Z < ZMIN)      Z = ZMIN;      /* clip to minimum value */
if (Z > ZMAX)      Z = ZMAX;      /* clip to maximum value */
RZ = ZMAX – ZMIN;                 /* Input (Z) range */
RC = CMAX – CMIN;                 /* Output (C) range */
C = CMIN + (((Z – ZMIN)/RZ)*RC;
```

In a slightly more complicated version of a mapping function, the function of Z just described may be constrained to produce a value only when the X and Y coordinates fall inside of some range. The new function C=f(Z, Y, X, ZMAX, ZMIN, XMAX, XMIN, YMAX, YMIN, CMAX, CMIN) would look as follows:

```
if ((Y>YMAX or (Y<YMIN)) return –1;
if ((X>XMAX or (X<XMIN)) return –1;
C=CMIN+(((Z–ZMIN)/RZ)*RC;
```

where CMAX, CMIN, Z, ZMIN, RZ and RC have the same definitions as in the prior example. The signal –1 is returned to indicate that the mapping failed to meet the input criteria; alternatively, this might have been set at CMIN or some other volume level.

The mapping may also employ any of the quantities $u_i$, $\bar{u}_i$, $a_i$, $\bar{a}_i$, $\omega$, $\alpha$, $\beta$, and $\gamma$, and/or the time derivatives of the foregoing, as inputs to the C function (like Z in the above examples), or as constraints on the C function (like X and Y in the second example). Such quantities are also available to be used as inputs or constraints in mappings relating to other musical attributes and effects.

Moreover, multiple effects or attributes may be mapped onto a given domain of inputs. For example, in FIG. 11 region 102 could correspond to a reverberation effect, region 104 to a tremolo effect and region 106 to a chorus effect, with both the reverberation and the chorus effects being produced in region 108 and both the tremolo and chorus effects being produced in region 110.

In the preferred embodiment, mapping modification unit 30 may also be provided with the ability to store mapping parameters and related programming commands as macros to permit the convenient modification of mappings based for different musical pieces. The execution of such macros might also be triggered by a digital signal from a clock in the mapping modification unit, so that a mapping could change after the lapse of a predetermined time interval. Alternatively, signals output from effects mapping unit 24 could also be used to control the mapping modification unit, so that execution of such macros could be triggered on the basis of a detected position. For example, a small region such as region 112 in FIG. 11 could be preserved in each mapping as a "trigger zone", permitting control of the mapping modification unit for example, on the basis of azimuth, velocity, or other parameters of motion or orientation) when data reflecting a position within such zone are input to mapping unit 24.

The present invention is not limited to the use of a Cartesian coordinate system. Other coordinate systems, such as cylindrical or spherical coordinate systems, could instead be implemented, for example by means of software transforming the Cartesian coordinate system-based output of accelerometers 36A1–38B3 into data pertaining to motions in such an alternative coordinate system.

The present invention thus provides the ability to greatly enhance the expression capability of a performer in a musical performance. By natural changes of position within a three-dimensional performance region, the performer may select various attributes of a musical tone or effects to be imparted to a musical tone, and such attributes or effects may be realized in the audio signal of an electronic musical instrument or of another musical instrument.

What is claimed is:

1. An electronic musical instrument, comprising:

a performance unit controlled by a performer that is freely movable within a three-dimensional performance region which includes said performance unit and said performer;

position-detecting means for setting a reference point within the performance region, detecting an absolute position of the performance unit in the performance region with respect to said reference point, and generating a position signal; and musical tone generating means for generating a musical tone based on such position signal.

2. An electronic musical instrument as in claim 1, further comprising:

orientation-detecting means for setting at least one axis containing the reference point, detecting the orientation of the performance unit with respect to such axis and generating an orientation signal;

and wherein said musical tone generating means generates a musical tone on the basis of the position signal and the orientation signal.

3. An electronic musical instrument as in claim 1, further comprising origin-selecting means for selecting a point within the performance region to function as said reference point, thereby permitting a performer to select such point during a performance.

4. An electronic musical instrument as in claim 1, further comprising MIDI instruction means for generating a musical tone control instruction conforming to the Musical Instrument Digital Interface standard on the basis of said position signal, and wherein said musical tone generating means generates a musical tone on the basis of said musical tone control instruction.

5. An electronic musical instrument as in claim 1, further comprising:

mapping selection means for selecting a correspondence of a characteristic of a musical tone to a value of the position signal and for controlling the musical tone generating means, whereby said musical tone generating means generates a musical tone having such characteristic when the position signal has a value in accordance with such correspondence.

6. An electronic musical instrument as in claim 2, further comprising:

mapping selection means for selecting a first correspondence of a first characteristic of a musical tone to a value of the position signal, selecting a second correspondence of a second characteristic of a musical tone to a value of the orientation signal, and controlling the musical tone generating means, whereby said musical tone generating means generates a musical tone having such first characteristic when the position signal has a value in accordance with such first correspondence and having such second characteristic when the orientation signal has a value in accordance with such second correspondence.

7. An electronic musical instrument as in claim 1, further comprising:

mapping selection means for selecting a first correspondence of a characteristic of a musical tone to a value of the position signal, selecting a second correspondence of a said characteristic of a musical tone to a value of the orientation signal, and controlling the musical tone generating means, whereby said musical tone generating means generates a musical tone having such characteristic only when both the position signal has a value in accordance with such first correspondence and when the orientation signal has a value in accordance with such second correspondence.

8. An electronic musical instrument, comprising:

a performance unit that is freely movable within a three-dimensional performance region, and having motion-sensing means including a plurality of accelerometers for detecting a characteristic of a motion of said performance unit in the performance region and generating a motion data signal based on said detected characteristic;

position-determining means for setting a reference point within the performance region, and determining an absolute position of the performance unit in the performance region with respect to said reference point based on said motion data signal, said position-determining means generating a position signal indicative of said absolute position; and musical tone generating means for generating a musical tone based on such position signal.

9. An electronic musical instrument as in claim 8, wherein said plurality of accelerometers are linear accelerometers.

10. An electronic musical instrument as in claim 8, wherein said motion-sensing means includes means for generating a translational motion data signal and a rotational motion data signal, and said position-detecting means detects a position of the performance unit on the basis of said translational motion data signal and said rotational motion data signal.

11. An electronic musical instrument as in claim 8, further comprising:

orientation-determining means for setting at least one axis containing the reference point, determining the orientation of the performance unit with respect to such axis on the basis of the motion data signal and generating an orientation signal;

and wherein said musical tone generating means generates a musical tone on the basis of the position signal and the orientation signal.

12. An electronic musical instrument as in claim 11, wherein said plurality of accelerometers are linear accelerometers.

13. An electronic musical instrument in claim 8, further comprising:

motion characteristic-determining means for determining at least one characteristic of a motion of the performance unit on the basis of the motion data signal and generating a motion characteristic signal;

and wherein the musical tone generating means generates a musical tone on the basis of the position signal and the motion characteristic signal.

14. An electronic musical instrument as in claim 13, wherein said plurality of accelerometers are linear accelerometers.

15. An electronic musical instrument as in claim 11, further comprising:

motion characteristic-determining means for determining at least one characteristic of a motion of the performance unit on the basis of the motion data signal and generating a motion characteristic signal;

and wherein the musical tone generating means generates a musical tone on the basis of the position signal, the orientation signal and the motion characteristic signal.

16. An electronic musical instrument as in claim 15, wherein said plurality of accelerometers are linear accelerometers.

17. An electronic musical instrument as in claim 8, further comprising origin-selecting means for selecting a point within the performance region to function as said reference point, thereby permitting a performer to select such point during a performance.

18. An electronic musical instrument as in claim 8, further comprising MIDI instruction means for generating a musical tone control instruction conforming to the Musical Instrument Digital Interface standard on the basis of said position signal, and wherein said musical tone generating means generates a musical tone on the basis of said musical tone control instruction.

19. An electronic musical instrument as in claim 11, further comprising MIDI instruction means for generating a musical tone control instruction conforming to the Musical Instrument Digital Interface standard on the basis of said position signal and orientation signal, and wherein said musical tone generating means generates a musical tone on the basis of said musical tone control instruction.

20. An electronic musical instrument as in claim 13, further comprising MIDI instruction means for generating a musical tone control instruction conforming to the Musical Instrument Digital Interface standard on the basis of said position signal and motion characteristic signal, and wherein said musical tone generating means generates a musical tone on the basis of said musical tone control instruction.

21. An electronic musical instrument as in claim 8, further comprising:

mapping selection means for selecting a correspondence of a characteristic of a musical tone to a value of the position signal and for controlling the musical tone generating means, whereby said musical tone generating means generates a musical tone having such characteristic when the position signal has a value in accordance with such correspondence.

22. An electronic musical instrument as in claim 11, further comprising:

mapping selection means for selecting a correspondence of a first characteristic of a musical tone to a value of the position signal, selecting a second correspondence of a second characteristic of a musical tone to a value of the orientation signal, and controlling the musical tone generating means, whereby said musical tone generating means generates a musical tone having such characteristic when the position signal has a value in accordance with such correspondence and having such second characteristic when the orientation signal has a value in accordance with such second correspondence.

23. An electronic musical instrument as in claim 13, further comprising:

mapping selection means for selecting a first correspondence of a first characteristic of a musical tone to a value of the position signal, selecting a second correspondence of a second characteristic of a musical tone to a value of the motion characteristic signal, and controlling the musical tone generating means, whereby said musical tone generating means generates a musical tone having such first characteristic when the position signal has a value in accordance with such first correspondence and having such second characteristic when the motion characteristic signal has a value in accordance with such second correspondence.

24. An electronic musical instrument as in claim 8, further comprising:

mapping selection means for selecting a first correspondence of a characteristic of a musical tone to a value of the position signal, selecting a second correspondence of a said characteristic of a musical tone to a value of the orientation signal, and controlling the musical tone generating means, whereby said musical tone generating means generates a musical tone having such characteristic only when both the position signal has a value in accordance with such first correspondence and when the orientation signal has a value in accordance with such second correspondence.

25. An electronic musical instrument as in claim 8, further comprising:

mapping selection means for selecting a first correspondence of a characteristic of a musical tone to a value of the position signal, selecting a second correspondence of a said characteristic of a musical tone to a value of the motion characteristic signal, and controlling the musical tone generating means, whereby said musical tone generating means generates a musical tone having such characteristic only when both the position signal has a value in accordance with such first correspondence and when the motion characteristic signal has a value in accordance with such second correspondence.

26. A musical tone control apparatus for use with a musical instrument, comprising:

a performance unit controlled by a performer that is freely movable within a three-dimensional performance region which includes said performance unit and said performer;

position-detecting means for setting a reference point within the performance region, detecting an absolute position of the performance unit in the performance region with respect to said reference point, and generating a position signal; and tone control means for generating a parameter control signal based on the position signal, wherein said parameter control signal is used to control a musical tone output by the musical instrument.

27. A musical tone control apparatus for use with a musical instrument as in claim 26, further comprising:

orientation-detecting means for setting at least one axis containing the reference point, detecting the orientation of the performance unit with respect to such axis and generating an orientation signal;

and wherein said tone control means generates a parameter control signal on the basis of the position signal and the orientation signal.

28. A musical tone control apparatus for use with a musical instrument as in claim 26, further comprising origin-selecting means for selecting a point within the performance region to function as said reference point, thereby permitting a performer to select such point during a performance.

29. A musical tone control apparatus for use with a musical instrument as in claim 26, further comprising MIDI instruction means for generating a musical tone control instruction conforming to the Musical Instrument Digital Interface standard on the basis of said position signal, and wherein said tone control means generates a parameter control signal on the basis of said musical tone control instructions.

30. A musical tone control apparatus for use with a musical instrument as in claim 26, further comprising:

mapping selection means for selecting a correspondence of a characteristic of a musical tone to a value of the position signal and for controlling the tone control means, whereby said tone control means generates a parameter control signal causing a musical tone produced by the musical instrument to have such characteristic when the position signal has a value in accordance with such correspondence.

31. A musical tone control apparatus for use with a musical instrument as in claim 26, further comprising:

mapping selection means for selecting a first correspondence of a first characteristic of a musical tone to a value of the position signal, selecting a second correspondence of a second characteristic of a musical tone to a value of the orientation signal, and controlling the tone control means, whereby said tone control means generates a parameter control signal causing a musical tone produced by the musical instrument to have such first characteristic when the position signal has a value in accordance with such first correspondence and to have such second characteristic when the orientation signal has a value in accordance with such second correspondence.

32. A musical tone control apparatus for use with a musical instrument as in claim 26, further comprising:

mapping selection means for selecting a first correspondence of a characteristic of a musical tone to a value of the position signal, selecting a second correspondence of a said characteristic of a musical tone to a value of the orientation signal, and controlling the tone control means, whereby said tone control means generates a parameter control signal causing a musical tone produced by the musical instrument to have such characteristic only when both the position signal has a value in accordance with such first correspondence and when the orientation signal has a value in accordance with such second correspondence.

33. A musical tone control apparatus for use with a musical instrument comprising:

a performance unit that is freely movable within a three-dimensional performance region, and having motion-sensing means including a plurality of accelerometers for detecting a characteristic of a motion of said performance unit in the performance region and generating a motion data signal based on said detected characteristic;

position-determining means for setting a reference point within the performance region, and determining an absolute position of the performance unit in the performance region with respect to said reference point based on said motion data signal, said position-determining means generating a position signal indicative of said absolute position; and tone control means for generating a parameter control signal based on the position signal, wherein said parameter control signal is used to control a musical tone output by the musical instrument.

34. A musical tone control apparatus for use with a musical instrument as in claim 31, wherein said plurality of accelerometers are linear accelerometers.

35. A musical tone control apparatus for use with a musical instrument as in claim 33, wherein said motion-sensing means includes means for generating a translational motion data signal and a rotational motion data signal, and said position-detecting means detects a position of the performance unit on the basis of said translational motion data signal and said rotational motion data signal.

36. A musical tone control apparatus for use with a musical instrument as in claim 33, further comprising:

orientation-determining means for setting at least one axis containing the reference point, determining the orientation of the performance unit with respect to such axis on the basis of the motion data signal and generating an orientation signal;

and wherein said tone control means generates a parameter control signal on the basis of the position signal and the orientation signal.

37. A musical tone control apparatus for use with a musical instrument as in claim 36, wherein said plurality of accelerometers are linear accelerometers.

38. A musical tone control apparatus for use with a musical instrument in claim 33, further comprising:

motion characteristic-determining means for determining at least one characteristic of a motion of the performance unit on the basis of the motion data signal and generating a motion characteristic signal;

and wherein the tone control means generates a parameter control signal on the basis of the position signal and the motion characteristic signal.

39. A musical tone control apparatus for use with a musical instrument as in claim 38, wherein said plurality of accelerometers are linear accelerometers.

40. A musical tone control apparatus for use with a musical instrument as in claim 36, further comprising:

motion characteristic-determining means for determining at least one characteristic of a motion of the performance unit on the basis of the motion data signal and generating a motion characteristic signal;

and wherein the tone control means generates a parameter control signal on the basis of the position signal, the orientation signal and the motion characteristic signal.

41. A musical tone control apparatus for use with a musical instrument as in claim 40, wherein said plurality of accelerometers are linear accelerometers.

42. A musical tone control apparatus for use with a musical instrument as in claim 33, further comprising origin-selecting means for selecting a point within the performance region to function as said reference point, thereby permitting a performer to select such point during a performance.

43. A musical tone control apparatus for use with a musical instrument as in claim 33, further comprising MIDI instruction means for generating a musical tone control instruction conforming to the Musical Instrument Digital Interface standard on the basis of said position signal, and wherein said tone control means generates a parameter control signal on the basis of said musical tone control instructions.

44. A musical tone control apparatus for use with a musical instrument as in claim 36, further comprising MIDI instruction means for generating a musical tone control instruction conforming to the Musical Instrument Digital Interface standard on the basis of said position signal and orientation signal, and wherein said tone control means generates a parameter control signal on the basis of said musical tone control instructions.

45. A musical tone control apparatus for use with a musical instrument as in claim 38, further comprising MIDI instruction means for generating a musical tone control instruction conforming to the Musical Instrument Digital Interface standard on the basis of said position signal and motion characteristic signal, and wherein said tone control means generates a parameter control signal on the basis of said musical tone control instruction.

46. A musical tone control apparatus for use with a musical instrument as in claim 33, further comprising:

mapping selection means for selecting a correspondence of a characteristic of a musical tone to a value of the position signal and for controlling the tone control means, whereby said tone control means generates a parameter control signal causing a musical tone produced by the musical instrument to have such characteristic when the position signal has a value in accordance with such correspondence.

47. A musical tone control apparatus for use with a musical instrument as in claim 33, further comprising:

mapping selection means for selecting a first correspondence of a first characteristic of a musical tone to a value of the position signal, selecting a second correspondence of a second characteristic of a musical tone to a value of the orientation signal, and controlling the tone control means, whereby said tone control means generates a parameter control signal causing a musical tone produced by the musical instrument to have such first characteristic when the position signal has a value in accordance with such first correspondence and to have such second characteristic when the orientation signal has a value in accordance with such second correspondence.

48. A musical tone control apparatus for use with a musical instrument as in claim 38, further comprising:

mapping selection means for selecting a first correspondence of a first characteristic of a musical tone to a value of the position signal, selecting a second correspondence of a second characteristic of a musical tone to a value of the motion characteristic signal, and controlling the tone control means, whereby said tone control means generates a parameter control signal causing a musical tone produced by the musical instrument to have such first characteristic when the position signal has a value in accordance with such first correspondence and to have such second characteristic when the motion characteristic signal has a value in accordance with such second correspondence.

49. A musical tone control apparatus for use with a musical instrument as in claim 33, further comprising:

mapping selection means for selecting a first correspondence of a characteristic of a musical tone to a value of the position signal, selecting a second correspondence of a said characteristic of a musical tone to a value of the orientation signal, and controlling the tone control means, whereby said tone control means generates a parameter control signal causing a musical tone produced by the musical instrument to have such characteristic only when both the position signal has a value in accordance with such first correspondence and when the orientation signal has a value in accordance with such second correspondence.

50. A musical tone control apparatus for use with a musical instrument as in claim 33, further comprising:

mapping selection means for selecting a first correspondence of a characteristic of a musical tone to a value of the position signal, selecting a second correspondence of a said characteristic of a musical tone to a value of the motion characteristic signal, and controlling the tone control means, whereby said tone control means generates a parameter control signal causing a musical tone produced by the musical instrument to have such characteristic only when both the position signal has a value in accordance with such first correspondence and when the motion characteristic signal has a value in accordance with such second correspondence.

* * * * *